US009651251B2

(12) United States Patent
Soltys

(10) Patent No.: US 9,651,251 B2
(45) Date of Patent: May 16, 2017

(54) METHODS AND SYSTEMS FOR CONTROLLING GAS TEMPERATURES

(71) Applicant: Mitsubishi Hitachi Power Systems Americas, Inc., Basking Ridge, NJ (US)

(72) Inventor: Roger A. Soltys, Pittstown, NJ (US)

(73) Assignee: MITSUBISHI HITACHI POWER SYSTEMS AMERICAS, INC., Basking Ridge, NJ (US)

( * ) Notice: Subject to any disclaimer, the term of this patent is extended or adjusted under 35 U.S.C. 154(b) by 0 days.

(21) Appl. No.: 15/178,754

(22) Filed: Jun. 10, 2016

(65) Prior Publication Data

US 2016/0281982 A1 Sep. 29, 2016

Related U.S. Application Data

(62) Division of application No. 13/725,486, filed on Dec. 21, 2012, now Pat. No. 9,388,978.

(51) Int. Cl.

| | |
|---|---|
| ***G05D 23/00*** | (2006.01) |
| ***F23J 11/00*** | (2006.01) |
| ***F22D 1/12*** | (2006.01) |

(52) U.S. Cl.

CPC ..... *F23J 11/00* (2013.01); *F22D 1/12* (2013.01)

(58) Field of Classification Search

CPC ..... F02C 7/10; F02C 3/30; F23C 6/04; F22B 1/1815; F22B 35/00; C10J 3/721; C02F 9/00

USPC .... 122/459, 4 D, 467, 448.1, 448.2; 432/14, 432/15, 58; 165/288, 293, 294, 296, 297, 165/299, 287, 901

See application file for complete search history.

(56) References Cited

U.S. PATENT DOCUMENTS 3,744,946 A * 7/1973 Lang ..... B22F 3/20 419/3
4,353,207 A * 10/1982 Lee ..... B01D 53/8631 122/7 B
4,454,838 A * 6/1984 Strohmeyer, Jr. ... F22B 31/0007 110/245
4,541,245 A * 9/1985 Becker ..... C04B 7/43 110/347
4,582,027 A * 4/1986 Cuscino ..... F22D 1/12 122/406.1

(Continued)

*Primary Examiner* — Gregory A Wilson
(74) *Attorney, Agent, or Firm* — Stephen T. Straub; Ronald P. Straub; Michael P. Straub

(57) ABSTRACT

Methods and systems for controlling the temperature of a heated flue gas stream downstream of a multi-part heat exchanger within a desired operating range through the use of a fluid bypass line which bypasses one or more sections, but not all sections, of the multi-part heat exchanger. In some but not necessarily all embodiments some fluid flow is maintained through the heat exchanger at all times. In one embodiment, the method includes sensing a temperature in said flue gas stream in proximity to an intermediate header of said multi-part heat exchanger and controlling a position of a bypass line control valve to control an amount of fluid passing through a fluid bypass line that bypasses the section of the multi-part heat exchanger between an inlet header and the intermediate header based on said temperature in said flue gas stream in proximity to the intermediate header of said multi-part heat exchanger.

10 Claims, 7 Drawing Sheets

(56) References Cited

U.S. PATENT DOCUMENTS 6,158,221 A * 12/2000 Fancher ..... F22B 1/1815
60/649
7,615,200 B2 * 11/2009 Lin ..... B01D 53/8631
422/105
7,637,233 B2 * 12/2009 Albrecht ..... F22D 1/12
122/467
8,286,595 B2 * 10/2012 Cerney ..... F22D 1/003
122/406.1
9,074,493 B2 * 7/2015 Wad ..... F01K 7/22

* cited by examiner

METHODS AND SYSTEMS FOR CONTROLLING GAS TEMPERATURES

CROSS REFERENCE TO RELATED APPLICATIONS

The present application is a divisional of U.S. patent application Ser. No. 13/725,486 filed Dec. 21, 2012 which is hereby expressly incorporated by reference in its entirety and which is owned by the assignee of the instant application.

FIELD OF INVENTION

The present invention relates to temperature control systems and, more particularly, to methods and systems for controlling the temperature of a heated gas stream such as a flue gas stream.

BACKGROUND OF THE INVENTION

One of the byproducts of combustion systems such as power plant boilers is exhaust gas, commonly known as flue gas. This gas may contain components which are harmful to the environment, such as oxides of nitrogen ($NO_x$). The production of $NO_x$ can occur when fuels are combusted, such as in steam generators, steam boilers, refinery heaters, turbines, etc. Exemplary fuels include coal, oil, natural gas, waste product such as municipal solid waste, petroleum coke, and other carbon-based materials. It is beneficial to the environment to control the levels of $NO_x$ released into the atmosphere by burning such fuels.

Fired steam generators, e.g., boilers, produce nitrogen oxides during the combustion process. In order to meet air quality standards, nitrogen oxides are one of the groups of emissions which are controlled. One common approach used to reduce nitrogen oxides in the flue gas is through the use of a selective catalytic reduction process, which converts nitrogen oxides to nitrogen and water through the catalytic reaction of ammonia and platinum within a certain heat range. At lower boiler loads, when the gas temperature leaving the boiler is below the minimum operating temperature of the catalyst, unconverted ammonia will react with the water vapor and sulfur trioxides present in the flue gas to form ammonium bisulfate and ammonium sulfate. Ammonium bisulfate is a sticky and corrosive salt that tends to precipitate out on the catalyst plate causing pluggage and de-activation of the catalyst. To counter this, it is necessary to raise the gas temperature leaving the boiler above the minimum operating temperature of the catalyst in order that the $NO_x$ reduction reaction can be sustained to boiler loads down to approximately 30% of full boiler load.

Heat exchangers are devices used to exchange or transfer heat. In many steam generators or boilers, a heat exchanger, e.g., economizer, is used to transfer heat from the flue gas to the water feeding the steam generator or boiler. This approach saves energy by preheating the fluid, i.e., water, supplied or fed to the steam generator or boiler. By transferring the heat from the flue gas to the feed fluid, which is referred to as feedwater, the temperature of the flue gas is reduced. When the gas temperature leaving the boiler is below the minimum operating temperature of the catalyst, the downstream selective catalytic reducer's (SCR's) ability to operate properly to remove $NO_x$ from the flue gas is affected as described above.

In a known system that attempts to address the aforementioned problems, an economizer bypass system is employed wherein all or part of the feed water bypasses the entire economizer to raise the temperature of the exiting flue gas. However, such systems have many limitations and disadvantages including for example requiring: (1) additional safety valves because the output of a heated section may be closed off and (2) mixing equipment to prevent steam from leaving the economizer and going to the furnace circuits. Moreover, such systems can cause thermal shock and premature failure of the tubes since hot water flow through the economizer may be stopped altogether during some period of time with the economizer tubes then being subject to stresses as cold water is introduced into the dry hot economizer causing sudden temperature changes and/or flashing.

In view of the above discussion it should be appreciated that there is a need for new and improved ways of controlling the flue gas stream temperatures of steam generators or boilers in order to reduce the level of $NO_x$ entering the atmosphere via the exiting flue gas. While known attempts to address these needs have obtained some level of success, there remains a need for new and improved methods and systems for controlling flue gas temperatures. It is desirable that one or more new methods and apparatus be developed which work well particularly during low load operation of steam generators or boilers without risk of flashing or thermal shock and without the need for expensive safety values or mixing systems at the fluid outlet of a heat exchanger.

SUMMARY OF THE INVENTION

The present invention relates to methods and systems for controlling the temperature of a heated flue gas stream at a downstream device such as, for example, an SCR.

One embodiment of the present invention relates to methods and systems for controlling the temperature of a heated flue gas stream of a steam generator at a location downstream of a multi-part heat exchanger within a desired operating range through the use of a fluid bypass line which bypasses one or more sections, but not all sections, of the multi-part heat exchanger.

When using a heat exchanger, such as an economizer water bypass system, one of the main concerns is generating steam in the economizer circuits. For example, in a subcritical boiler this could lead to steam being carried over to the boiler drum, which could negatively impact the circulation of water through the boiler's furnace tubes resulting in furnace tube overheating and failing. In a supercritical boiler, introducing steam into the furnace tubes will lead to "drying out" the tubes earlier than expected, leading to the tubes in the upper furnace operating at temperatures above the design temperature, which will result in premature tube failure. To insure that steam will not reach the furnace tubes, in the event that the economizer generates steam when in the bypass mode, at least one known system relies on the use of special mixing devices to keep the steam in contact with the sub-cooled bypass water to insure that any steam present will condense.

In contrast to such a known system, in the system of the present invention, only a portion of an economizer, e.g., one or more sections that are located between the economizer input header and an intermediate header are bypassed. Thus, if steam is generated in the bypassed section of the economizer of the present invention, the steam has time to condense between the mixing point at the intermediate header before reaching the furnace. Thus, by using a sufficiently long resident time between the mixing point and the output of the economizer any steam generated will be condensed and steam will not be output by the economizer eliminating the need for mixing equipment at the output of the economizer as compared to the known system.

The economizer of the present invention is less likely to steam when the economizer is partially bypassed as compared to systems which fully bypass the economizer during certain modes of operation. Furthermore if steam is generated in the partially bypassed section, it will be a lesser amount than would be generated if the entire economizer was fully bypassed. Moreover, the economizer of the present invention may, and in some embodiments is used without, relief valves at the output of the economizer, an output economizer control valve, or special mixing devices at the economizer's output. Thus, the economizer of the present invention while being safe can be implemented with fewer safety devices than known systems which fully bypass an economizer.

In the known system where the economizer is completely bypassed, the system includes a control valve in the economizer line at the outlet of the economizer. Section I of the ASME Boiler and Pressure Vessel Code requires relieving capacity for a heated economizer with valves on either end. Because of this requirement, a safety valve and exhaust piping is included downstream of the economizer outlet in systems which fully bypass the economizer and which have valves on each end of the economizer which is common in full bypass systems.

In one aspect of the present invention, the partial economizer bypass system does not require a safety valve because the economizer flow control valve is located before the inlet of the economizer and the economizer does not have a valve at both ends which could result in the economizer being fully closed off.

In a known system which operates with the economizer completely bypassed during startup, when sub-cooled feedwater is finally allowed to flow through the economizer after start up, steam flashing tends to occur. This increases the risk and likelihood that steam from the flashing could be carried to the furnace circuits resulting in damage to the furnace circuits. Furthermore, the introduction of sub-cooled water to hot dry tubes results in thermal shock, which in turn causes shortened tube life.

In accordance with one aspect of the present invention, at no time is the economizer completely bypassed. In addition, in some embodiments but not necessarily all embodiments some flow is maintained through the sections of the economizer at all times of operation. For example, in some embodiments a minimum of five to ten percent of the total feedwater flow will be maintained at low boiler load, where the maximum amount of gas temperature correction will be required. Thus, some fluid flow occurs through the economizer even during low load conditions increasing system safety and reducing the chance for significant thermal shock to the economizer tubes.

In accordance with one aspect of the present invention unlike a known system, which bypasses the entire economizer, one embodiment of the present invention allows for the full flow of feedwater through the support tubes instead of a reduced flow of water through the support tubes. In support tubes with reduced water full such as the known system there is the potential for overheating of the support tubes which weakens the support tubes and sometimes requires the support tubes be upgraded to be made of more costly alloys that can withstand higher temperatures. Whereas the full flow of water through the support tubes in accordance with one aspect of the present invention allows the support tubes to operate at normal temperatures eliminating the problem encountered with the overheating of the support tubes in the known system and the need for upgrades to or usage of more costly alloys for the support tubes.

The methods and apparatus of the present invention are suitable for a wide range of boiler applications and designs including split pass boilers. In split pass boilers, the back, or convection pass, is split into two parallel gas passes. In such embodiments the economizer surface is also usually split into two parts. For example, one part will normally be below the two parallel passes and one part will be in the lowest section of either the right or left side of one of the parallel gas passes. Each of these sections will normally comprise two or more banks, or groups of tubes separated by cavities. The economizer tubes in the common section of the pass below the side by side passes may be in line with the tube in the side by side passes or rotated 90° relative to the orientation of those tubes.

In one embodiment of the present invention, the feedwater to the economizer is controlled by bypassing feedwater around the banks of the economizer section located in a common pass below the parallel passes of a split boiler system. Bypassing water around this section of the economizer reduces the ability of the tubes to remove heat from the flue gas, resulting in an increase in the temperature of the flue gas leaving the boiler, and allowing the catalytic reduction of nitrous oxides to continue at boiler loads when the exiting gas temperature is normally too low. This control is normally required at loads between 30 and 70% of full boiler load. Above about 70% of full boiler load, when the gas temperature leaving the boiler is sufficiently high for the catalytic reaction to be sustained, the economizer section bypass is not in operation.

In one embodiment of the present invention for controlling the temperature of a heated flue gas stream at a downstream device within a desired operating temperature range, the system comprises: a multipart heat exchanger comprising: a first heat exchanger section located in said flue gas stream said first heat exchanger section having a fluid inlet coupled to a fluid feed line; a second heat exchanger section located in series with said first heat exchanger section in said flue gas stream, said second heat exchanger section being located upstream of said first heat exchanger section in said flue gas stream; an intermediate header having a first mixer fluid input, a second mixer fluid input, and a fluid outlet, said first mixer fluid input being coupled to a fluid output of said first heat exchanger section, and said fluid outlet being coupled to a fluid inlet of said second heat exchanger section; and a fluid bypass line coupling said fluid feed line to said second mixer fluid input of said intermediate header, said fluid bypass line extending outside of said flue gas stream and providing a fluid bypass allowing at least some fluid supplied by said fluid feed line to fully bypass said first heat exchanger section.

Numerous additional features and embodiments are described in the detailed description which follows.

DETAILED DESCRIPTION

Figure 1:
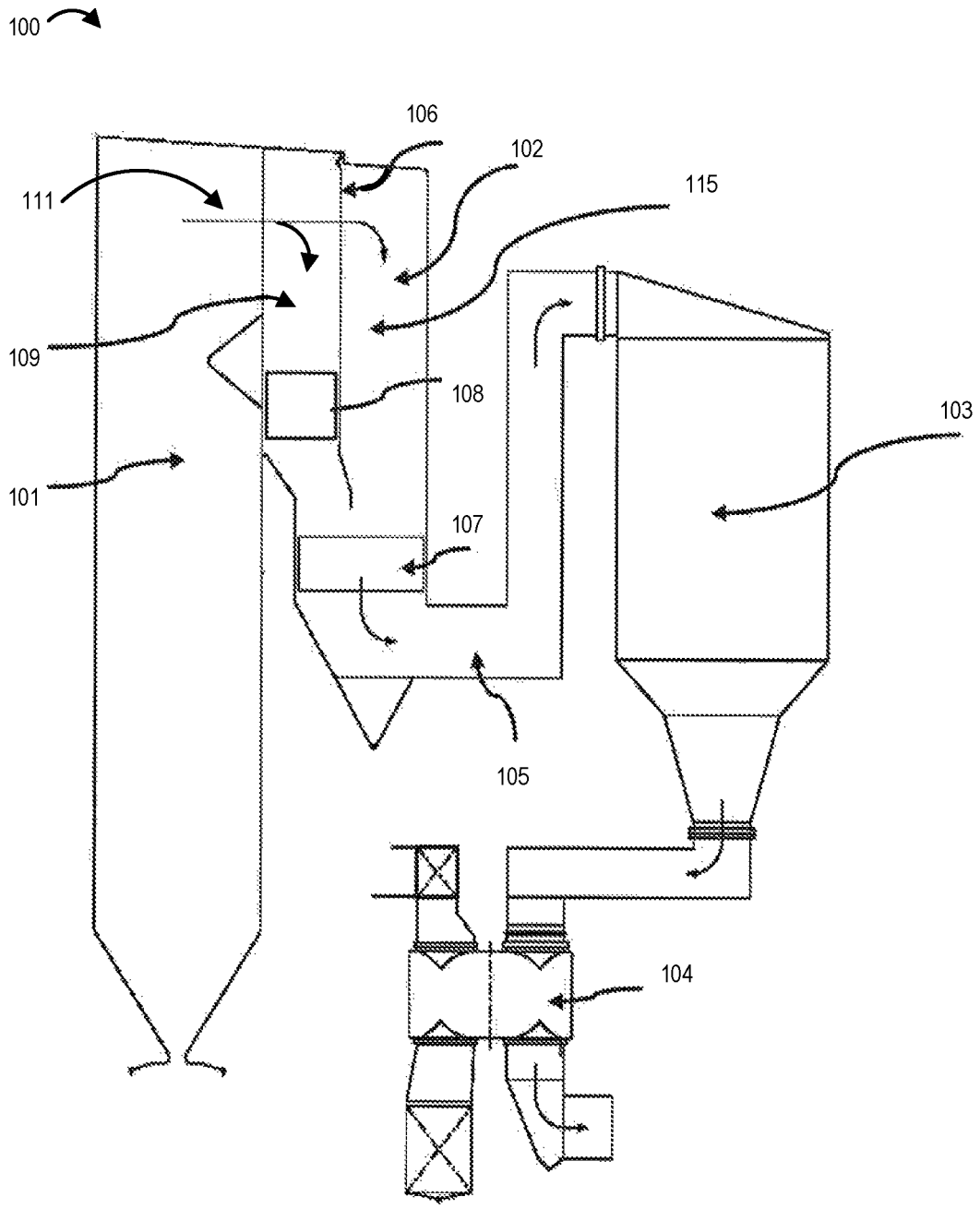
FIG. 1 illustrates an exemplary steam generator with a split convection pass implemented in accordance with an exemplary embodiment of the invention.

System 100 of FIG. 1 illustrates an exemplary steam generator or boiler 101, with a split convection pass 102 including a selective catalytic reducer (SCR) 103 sometimes referred to as a selective catalytic converter, a multi-part heat exchanger which includes an upper economizer section 108 and a lower economizer section 107, and an air heater 104. The convection pass in a split pass boiler is divided into two sections with the use of a partition wall 106. Flue gas 111 from the steam generator flows through the convection pass 102, through the flue 105, then into the SCR 103 and into the air heater 104. After the air heater 104, the flue gas may, and in some embodiments of the present invention does, flow through equipment which removes particulate matter and sulfur oxides from the flue gas before the flue gas is discharged to the atmosphere. The upper economizer section 108 is located in the lower section of the inboard section 109 of the split convection pass. In some embodiments, the upper economizer section 108 is located in the lower section of the outboard section 115 of the split convection pass.

Figure 2:
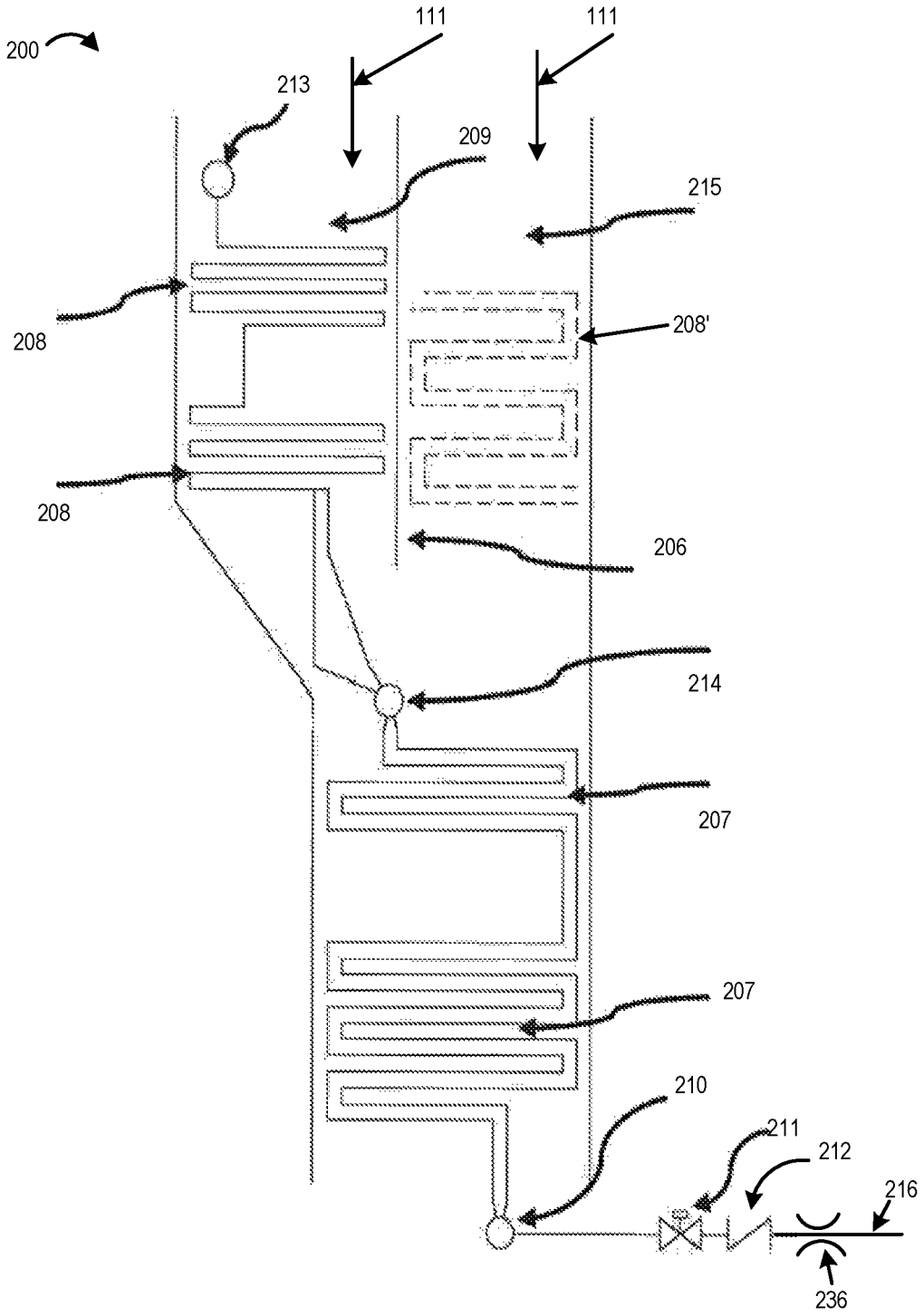
FIG. 2 illustrates an exemplary economizer arrangement for a steam generator with a split convection pass without an economizer fluid bypass line.
Figure 3:
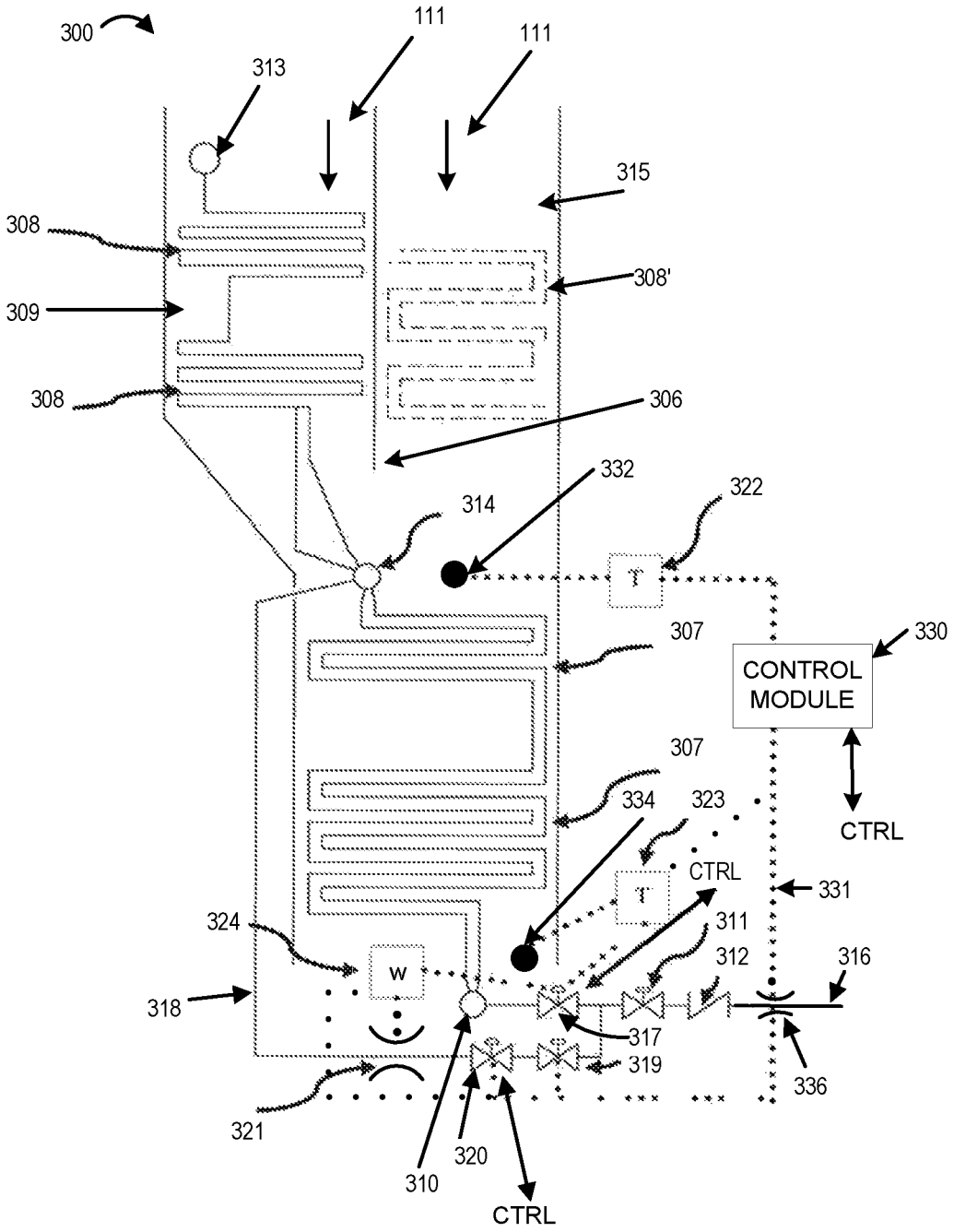
FIG. 3 illustrates an exemplary economizer arrangement with an exemplary partial bypass system for a steam generator with a split convection pass in accordance with one embodiment of the present invention.
Figure 4:
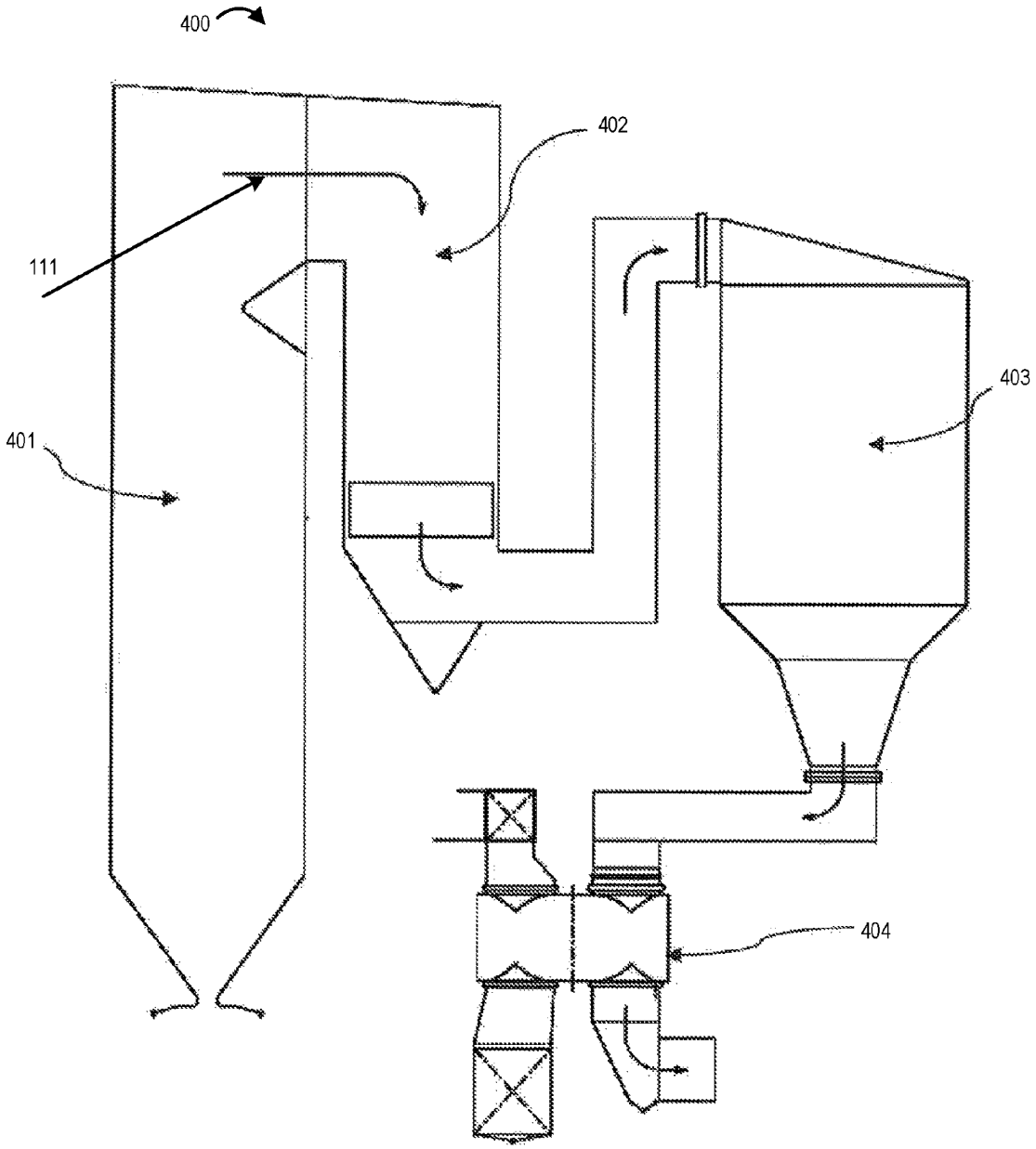
FIG. 4 illustrates an exemplary steam generator with a single convection pass implemented in accordance with an exemplary embodiment of the invention.
Figure 6:
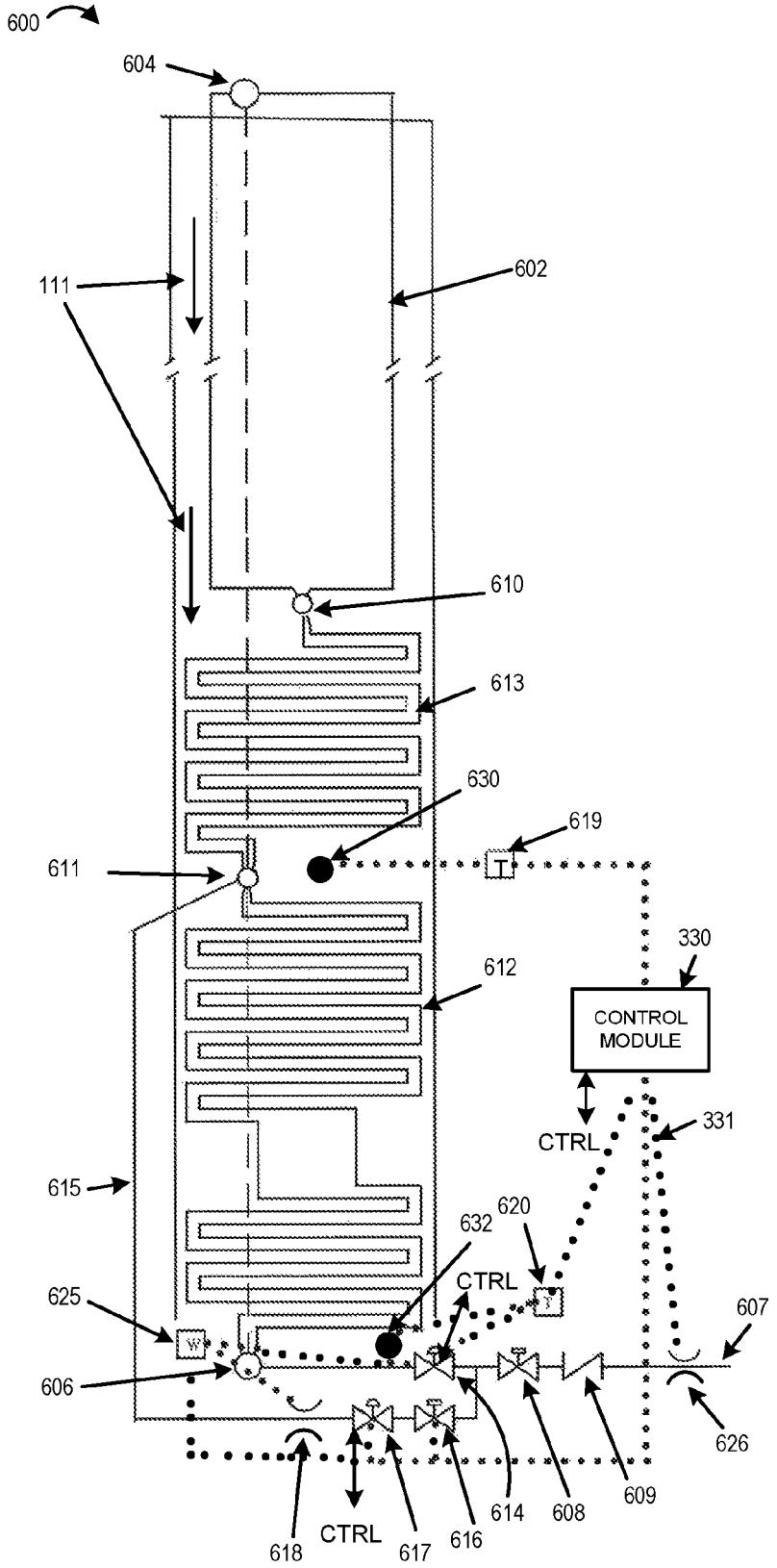
FIG. 6 illustrates an exemplary economizer arrangement with an exemplary partial bypass system for a steam generator with a single convection pass in accordance with one embodiment of the present invention.
Figure 7:
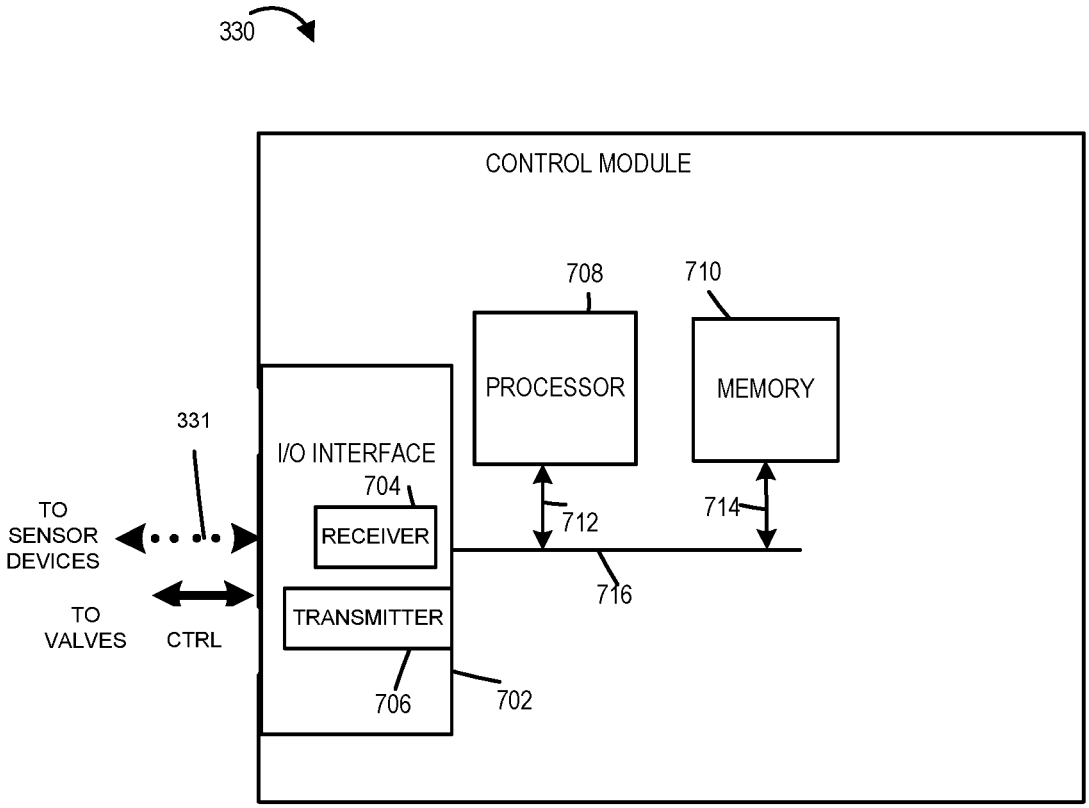
FIG. 7 illustrates an exemplary control module in accordance with one embodiment of the present invention.

Elements of FIGS. 2, 3 and 7 which are the same or similar to the elements of FIG. 1 are identified using the same reference number. Elements of FIGS. 5 and 6 which are the same or similar to the elements of FIG. 4 are identified using the same reference number. The flue gas has been referred to throughout the Figures as flue gas 111.

Diagram 200 of FIG. 2 shows details of an economizer arrangement with a split convection pass without a fluid feed line economizer bypass. The convection pass in a split pass boiler is divided into two sections with the use of a partition wall 206. The economizer surface is split into two sections in a split pass design. The lower economizer section 207 occupies space beneath the two passes. The upper economizer section 208 is located in the lower section of the inboard section 209. Alternatively the upper economizer section 208 may be and, in some embodiments is, located in the lower section of the outboard section 215 of the split convection pass. The upper economizer in this alternative arrangement is shown with dashed lines and labeled as 208'. For some steam generator designs with a split convection pass, the partition wall may be, and is, extended down to the boiler exit, splitting the lower economizer into two sections.

The inlet of the lower economizer 207 is connected to an inlet header 210, which receives the feedwater to the boiler. This feedwater line 216 contains a flow measuring device 236, a feed stop valve 211, and a feed check valve 212. The upper economizer section 208 is connected to an outlet header 213, which in the case of a subcritical or drum boiler is connected to the boiler drum, or in the case of a super critical or once through boiler, is connected to the furnace circuitry. The lower economizer section 207 is usually, but need not be, connected to the upper economizer by the use of an intermediate header 214. The purpose of the economizer is to reduce the temperature of the combustion gas leaving the boiler by heating the feedwater to the boiler.

The flue gas 111, which leaves the boiler, is passed through a selective catalytic converter (SCR), which removes the nitrous oxides in the flue gas by converting them into nitrogen and water through the interaction of the nitrous oxides and ammonia in the presence of a catalyst. This reaction occurs within a specific temperature range, typically 580 to 800° F. At lower boiler loads, the temperature of the flue gas will fall below the minimum catalyst operating range and be too low to sustain the reaction without permanently damaging the catalyst.

The gas temperature leaving the boiler can be raised during low load operation by bypassing some of the feedwater around part of the economizer surface, i.e., a section of the economizer. Diagram 300 of FIG. 3 illustrates an exemplary economizer arrangement with an exemplary partial bypass system for a steam generator with a split convection pass in accordance with one embodiment of the present invention.

Diagram 300 of FIG. 3 includes a multi-part heat exchanger with a partial bypass and associated controls. The multi-part heat exchanger is illustrated as a multi-part economizer with the first or lower economizer section 307 located in the flue gas stream 111 in the common pass below the split pass convection pass and the second or upper economizer section 308 is connected in series to the lower economizer section 307 and located upstream in the flue gas stream in one part of the split pass. The convection pass is split into two sections with the use of a partition wall 306.

The upper economizer section 308 is located in the lower section of the inboard section 309. Alternatively the upper economizer section 308' may be and, in some embodiments is, located in the lower section of the outboard section 315 of the split convection pass. The upper economizer in this alternative arrangement is shown with dashed lines and labeled as 308'. As previously discussed in connection with FIG. 2, for some steam generator designs with a split convection pass, the partition wall may be, and is, extended down to the boiler exit, splitting the lower economizer into two sections.

The lower economizer section 307 has a fluid inlet coupled to a fluid feed line. Diagram 300 also includes an intermediate header 314, an inlet header 310, an outlet header 313, a fluid bypass line 318, and a boiler fluid feed line 316. The fluid bypass line extends outside of the flue gas stream 111 and provides a fluid bypass allowing at least some fluid supplied by the fluid feed line 316 to fully bypass the first section of the heat exchanger that is the lower economizer section 307 of the exemplary system. The fluid bypass line 318 may be, and in some embodiments of the present invention is, implemented as a feedwater bypass pipe. The intermediate header 314 has a first mixer fluid input, a second mixer fluid input and a fluid outlet. The first mixer fluid input of the intermediate header 314 is coupled to a fluid output of the lower heat exchanger section 307. The fluid bypass line 318 couples the fluid feed line 316 to the second mixer fluid input of the intermediate header 314. The fluid outlet of the intermediate header 314 is coupled to a fluid inlet of the second or upper economizer section 308.

Located in the fluid feed line 316 are the boiler feed stop valve 311 and the boiler feed check valve 312. Between the feed stop and check valves and the economizer inlet header 310 is a multi-position control valve 317 that regulates the flow of fluid between the fluid bypass line 318 and the lower economizer section 307. The control valve 317 is coupled to control module 330. The control valve 317 communicates with the control module 330 and receives one or more control signals (CTRL) from control module 330. The one or more control signals from the control module 330 control the position of the control valve and therein the amount of fluid flowing through the control valve 317. The control module 330 is shown in further detail in FIG. 7 and is discussed further below.

The fluid feedwater bypass line is placed between the fluid feed pipe 316, also referred to as the boiler feed pipe 316, and the economizer's intermediate header 314. The intermediate header 314 functions as a mixing header when the economizer partial bypass is in operation. In the exemplary embodiment of diagram 300 a block valve 319, a control valve 320, and a flow measuring device 321 are located in the fluid bypass line 318. In some embodiments of the present invention, a control valve is not included in the fluid bypass line 318. However, including a control valve in the fluid bypass line increases the controllability of the system.

The economizer partial bypass system of the present invention extends the operating range of an SCR, which has an operating range based on a minimum and maximum gas temperature. In order to extend the operating range, the gas temperature leaving the boiler during low load operation needs to be increased when the gas temperature leaving the boiler is below the minimum operating temperature of the SCR. Examples of low load operation include when the boiler is started up and when the load is being decreased. The operation of the exemplary economizer partial bypass system is explained in detail below in connection with the load conditions of boiler start up and when the boiler load is being decreased.

During boiler start up, the block valve 319 and the control valve 320 in the fluid bypass line 318 are fully opened when the temperature of the flue gas 111 entering the section of the economizer to be bypassed approaches about 700° F. as measured by the temperature sensor 322 at probe point 332 which is in the proximity of the intermediate header. Temperature sensor 322 transmits a signal indicative of the measured temperature to the control module 330. During this time, the temperature of the flue gas 111 leaving the boiler is monitored by temperature sensor 323 at probe point 334 which is in the gas stream in the proximity of the boiler exit which may be and in some embodiments is also in the proximity of the fluid inlet header. Temperature sensor 323 transmits a signal indicative of the measured temperature to the control module 330. The fluid flow through the lower section of the economizer 307 and the fluid flow through the fluid bypass line 318 are also monitored by flow sensor device 324. The flow monitoring is based on measurements made by flow measuring device 321 in the fluid bypass line along with flow measurements made by the boiler feed line measuring device 336 also referred to as the boiler feed water measuring device 336. The flow sensor device 324 and/or flow measuring devices 321 and 336 transmit one or more signals to the control module 330 indicative of the measured flow of fluid through the fluid bypass line 318 and the fluid feed line 316 as measured by flow measuring devices 321 and 336. The one or more signals are transmitted over communication link 331 shown as a dotted line in FIG. 3.

In some embodiments, a flow measuring device is placed in the feedwater line 316 between the input header 310 and control valve 317 which is used to monitor the flow of the feedwater being supplied to the lower portion of the economizer 307. This flow measuring device is coupled to the control module 330 and/or the flow sensor device 324. This flow measuring device transmits one or more signals indicative of the measure of the flow of fluid through the fluid feed line between the input header 310 and the control valve 317 which may be used in determining the correct valve positions for the system to obtain the desired operating temperature.

The control module 330 upon receipt of the temperature and flow measurement information processes the received information to determine when the desired minimum operating load for the SCR is approaching based on the fluid flow and temperature measurements received from the temperature sensors 322, 323 and flow sensor device 324. As the desired minimum operating load approaches, the control module transmits control signals CTRL to control valve 317 and the control valve 317 is modulated closed to restrict the flow of fluid to the economizer lower section 307. The control module also transmits signals to the bypass control valve 320 to adjust the position of the multi-position valve if necessary to increase the fluid flow through the fluid bypass line 318. As the fluid flow through the economizer lower section 307 is reduced, the gas temperature leaving the boiler and flowing to the SCR increases. This temperature is measured at sensing point 334 by temperature sensor 323 and a signal indicative of this measurement will be sent to control module 330. The control module continues modulating the control valves 320 and 317 until the desired gas temperature is achieved. At no point is the economizer control valve 317 fully closed. In some, but not all embodiments of the present invention, the control module is configured to control the position of the control valve 320 as a function of the temperature measured by temperature sensor 322 at probe point 332 which is in the flue gas in proximity to the intermediate header 314. In some embodiments of the present invention, the control module is further configured to vary the amount of fluid flow through the bypass line 318 in response to changes in the temperature sensed at probe point 332.

As the boiler load increases, the control module sends control signals to the economizer control valve 317 causing control valve 317 to modulate open to maintain the desired boiler outlet temperature. When the economizer control valve 317 is fully opened, and as the load continues to increase, the control module sends control signals to the bypass control valve 320 causing the bypass control valve to modulate to the closed position. The modulation of the economizer control valve 317 and bypass control valve 320 are controlled via control signals (CTRL) transmitted from the control module 330 to the control valves 317 and 320 as a function of temperature sensing measurements and fluid flow measurements provided from sensor devices 322, 323, and 324 transmitted to the control module. In some embodiments, but not all embodiments of the present invention, the control module is configured to control the economizer control valve 317 based on the temperature sensed by temperature sensor 322 at probe point 332 and/or temperature sensor 323 at probe point 334.

When boiler load is being decreased, and as the minimum SCR operating temperature is being approached, the partial bypass operating procedure described above in connection with boiler startup is reversed.

The present invention is also applicable to single convection pass boilers also know as series pass boilers. In a single convection pass boiler the back pass or convection pass consists of a single gas pass.

In an exemplary single convection series pass boiler in accordance with the present invention, the economizer consists of three sections or banks of surface and the feedwater to the economizer is controlled by bypassing feedwater around the bottom two sections or banks of the economizer. In some embodiments of the present invention, the economizer consists of only two sections or banks. In such systems, only one economizer section or bank is bypassed. The economizer is located in the lowest part of this pass and consists of two or more banks, or groups of tubes separated by cavities.

For some economizers in a single convection pass boiler in accordance with the present invention, the inlet headers are supported by vertical tubes which pass through the convection pass roof. By placing the intermediate header in line with the economizer inlet header allows for full water flow through the support tubes above the intermediate header. Because of the higher gas temperatures in the upper part of the convection pass, reduced flow through the support tubes may and sometimes does lead to overheating which leads to a weakening of the support tubes. Unlike a known system, which bypasses the entire economizer, embodiments of the present invention have full flow through these support tubes therein allowing the support tubes to operate at normal temperatures eliminating the possible need for upgrades to more costly alloys. In some embodiments of the present invention, this design feature also applies to the vertical economizer tubes which are used to support all the horizontal tubes in the convection pass.

Diagram 400 of FIG. 4 illustrates a typical steam generator or boiler 401, with a single convection pass 402 including an SCR 403, which is the catalytic converter, and an air heater 404. In some embodiments after the air heater 404, the flue gas 111 usually, but not always, flows through additional equipment which removes particulate matter and sulfur oxides from the flue gas 111 before the flue gas 111 is discharged to the atmosphere.

Figure 5:
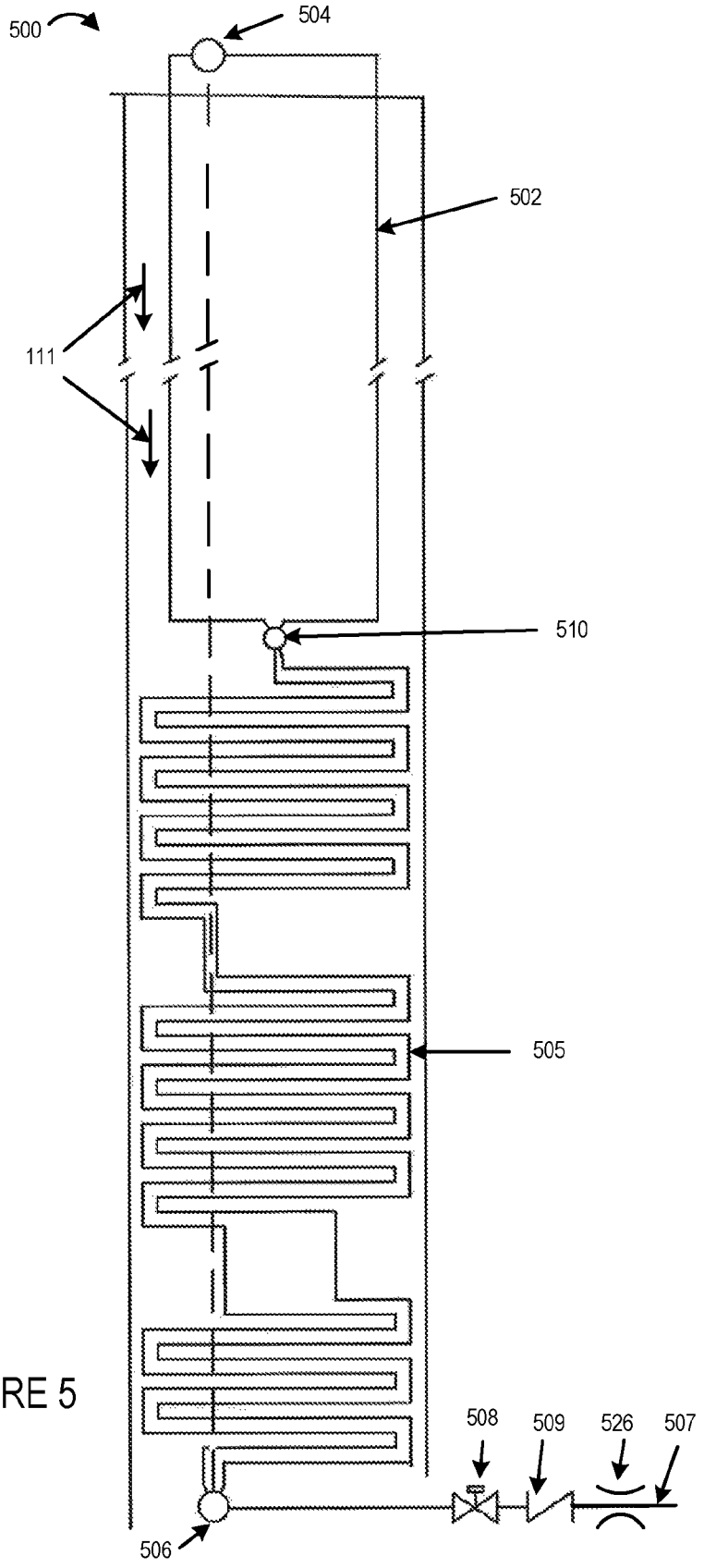
FIG. 5 illustrates an exemplary economizer arrangement for a steam generator with a single convection pass without an economizer fluid bypass line.

Diagram 500 of FIG. 5 illustrates an economizer arrangement or a boiler with a single convection pass without an economizer bypass arrangement. The inlet of the lower section of the economizer 505 is connected to an inlet header 506, which receives the feedwater to the boiler. The feedwater line 507 contains a feed stop valve 508, a feed check valve 509, and a boiler feed water measuring device 526. The upper section of the economizer is transitioned to vertical tubes 502, which are used to support all the horizontal sections of tubes from the bottom to the top of the gas pass. The upper horizontal bank of economizer tubes may, and in some cases, are connected to a transition header 510 between the top horizontal bank of the economizer and the vertical economizer support tubes 502. These vertical support tubes are connected to an outlet header 504. In the case of a subcritical or drum boiler this outlet header 504 is connected to the boiler drum. In the case of a super critical or once through boiler, the outlet header 504 is connected to the furnace circuitry. The economizer is a multi-part or multi-section heat exchanger which functions to reduce the temperature of the combustion gas also referred to as the flue gas leaving the boiler by heating the feedwater to the boiler. In some such systems no transition header 510 is used and the economizer 505 is connected to the outlet header 504.

The flue gas 111, which leaves the single pass convection boiler, is passed through a SCR, which removes the nitrous oxides in the flue gas by converting them into nitrogen and water through the interaction of the nitrous oxides and ammonia, in the presence of a catalyst and heat. As previously discussed, this reaction occurs within a specific temperature range, typically 580 to 800° F. Similar to the split convection pass boiler operation described above, at lower boiler loads, the temperature of the flue gas falls below the minimum catalyst operating range and is too low to sustain the reaction without permanently damaging the catalyst.

In embodiments of the present invention, the gas temperature leaving the boiler is raised during low load operation by bypassing some of the feed fluid referred to as feedwater around part of the economizer surface. Diagram 600 of FIG. 6 illustrates an exemplary economizer arrangement with an exemplary partial bypass system for a steam generator with a single convection pass in accordance with one embodiment of the present invention.

Shown in diagram 600 of FIG. 6 is the multi-part economizer incorporating the bypass, which includes an intermediate header 611 between the bypassed first section of the economizer 612 and non-bypassed second section of the economizer 613, an inlet header 606, a transition header 610, an outlet header 604 and a boiler fluid feed line 607. As explained in connection with FIG. 5, the upper horizontal bank of economizer tubes may, and in some embodiments of the present invention is, connected to a transition header 610 between the top horizontal bank of the economizer and the vertical economizer support tubes 602. These vertical support tubes 602 are connected to an outlet header 604. In the case of a subcritical or drum boiler this outlet header 604 is connected to the boiler drum. In the case of a super critical or once through boiler, the outlet header 604 is connected to the furnace circuitry. The economizer is a multi-part or multi-section heat exchanger which functions to reduce the temperature of the combustion gas also referred to as the flue gas leaving the boiler by heating the feedwater to the boiler. In some embodiments of the present invention, there is no transition header 610 and the upper section of the economizer 613 is connected to the output header 604.

The fluid used in the fluid feed line is water and the fluid feed line is sometimes referred to as the feedwater line. A boiler feed stop valve 608 and a boiler feed check valve 609 are located in the fluid feed line 607. The fluid feed line 607 in some embodiments is a fluid feedwater pipe. Between the feed stop and check valves and the economizer inlet header 610 is a control valve 614 that is used to regulate the flow between the fluid bypass line 615 and the first section of the economizer 612. In some embodiments the fluid bypass line 615 is a fluid bypass pipe. The fluid bypass line 615 is placed between the boiler feed line 607 and the intermediate header 611. The intermediate header functions as a mixing header when the economizer bypass is in operation. In the exemplary embodiment of diagram 600 a block valve 616, a control valve 617, and a flow measuring device 618 are located in the fluid bypass line 615. In some embodiments of the present invention, a control valve such as control valve 617 is not included in the fluid bypass line 615. However, including a control valve in the bypass line increases the controllability of the system.

As previously discussed in connection with the split pass convection boiler system described above, the economizer bypass system of the present invention extends the operating range of a SCR, which has an operating range based on a minimum and maximum gas temperature. In order to extend the operating range, it is necessary to increase the gas temperature leaving the boiler during low load operation when the gas temperature leaving the boiler is below the minimum operating temperature of the SCR. Low load times include boiler start up and when the boiler load is being decreased. An explanation of how the exemplary economizer partial bypass system is used to increase the gas temperature leaving a single pass convection boiler to extend the operating range of a SCR located downstream from the boiler during boiler start up and when the boiler load is being decreased is discussed below.

During boiler start up, the block valve 616 and the control valve 617 in the fluid bypass line 615 are fully opened when the gas temperature of the flue gas 111 entering the first section of economizer approaches about 700° F. as measured by the temperature sensor 619 at a probe point 630 which is in the flue gas in the proximity of the intermediate header 611. The temperature sensor 619 transmits a signal indicative of the measured temperature to the control module 330. During this time, the temperature of the flue gas 111 leaving the boiler is monitored by temperature sensor 620 at a probe point 632 which is in the gas stream in the proximity of the boiler exit. In some embodiments the temperature of the flue gas 111 leaving the boiler is monitored by temperature sensor 620 at a probe point 632 which is in the proximity of the input header 606. Temperature sensor 620 transmits a signal indicative of the measured temperature to the control module 330. The fluid flow through the first section of the economizer 612 and the flow through the fluid bypass line 615 is monitored by flow sensor 625 monitored. The flow monitoring will be based on measurements made by the flow measuring device 618 in the fluid bypass line 615 along with the flow measurements made by the boiler feed water measuring device 626 in the fluid feed line 607 as measured by the flow measuring devices 618 and 626. The flow sensor device 625 and/or the flow measuring devices 618 and 626 transmit one or more signals to the control module 330 indicative of the measured flow of fluid through the fluid bypass line 615 and the fluid feed line 607.

In some embodiments, a flow measuring device is placed in the feedwater line 607 between the input header 606 and control valve 614 which is used to monitor the flow of the feedwater being supplied to the lower portion of the economizer 612. This flow measuring device is coupled to the control module 330 and/or the flow sensor device 625. This flow measuring device transmits one or more signals indicative of the measure of the flow of fluid through the fluid feed line between the input header 606 and the control valve 614 which may be used in determining the correct valve positions for the system to obtain the desired operating temperature. The one or more signals are transmitted over communication link 331 shown as a dotted line in FIG. 6.

The control module upon receipt of the temperature and flow measurement information processes the received information to determine when the desired minimum operating load for the SCR is approaching based on the fluid flow and temperature measurements received from the temperature sensors 619 and 620 and flow sensor device 625. As the boiler load increases and starts to approach the minimum operating load for the SCR, the control module 330 transmits control signals (CTRL) to the economizer control valve 614 to cause the economizer control valve to be modulated to a partially closed position to restrict flow to the first section of the economizer 612 and increase flow through the fluid bypass line 615. As the flow through the first section of the economizer is being reduced, the gas temperature leaving the boiler as measured by temperature sensor 620 at probe point 632 which is in the gas stream in the proximity of the boiler exit increases thereby increasing gas temperature of the downstream SCR. The control module 330 continues to modulate the control values 614 and 617 until the desired gas temperature is achieved. At no point is the economizer control valve 614 modulated to a fully closed position. As boiler load increases, the control module transmits control signals to the economizer control valve 614 that causes the control valve 614 to modulate open to maintain the desired boiler outlet flue gas temperature. When the economizer control valve 614 is fully opened, and as the boiler load continues to increase, the bypass control valve 617 is commanded to modulate to the closed position by a control signal sent to the bypass control valve 617 from the control module 330.

When boiler load is being decreased, and as the minimum SCR operating temperature is being approached, the partial bypass operating procedure is reversed from the procedure used for start up.

FIG. 7 illustrates some of the elements of control module 330 in further detail. The control module 330 includes an Input/Output (I/O) Interface 702, a processor 708, a memory 710, and communication links 716, 712 and 714. The communication link 716 may be and in some embodiments is a communication bus. In some embodiments, the communications links 716, 712 and 714 are wires or traces. Communication link 712 couples processor 708 to communication link 716. Communication link 714 couples memory 710 to communication link 716. The I/O Interface 702 is also coupled to communication link 716. Processor 708, memory 710, and I/O Interface 702 communicate over communication link 716. Memory 710 may, and in some embodiments does, include programming instructions for configuring the control module and performing operations on the processor 708. Memory 710 is also used for storing data such as for example the temperature and flow measurements received from sensors and position status for various valves. The I/O Interface 702 further includes a receiver 704 and transmitter 706. The sensor devices send sensor measurement information and data to the control module 330 via communication link 331 such as temperature and flow measurements. The valves may, and in some embodiments do transmit valve position information to the control module. The receiver 704 receives the information and provides it to processor 708 via communication links 716 and 712. The processor may, and in some embodiments does, store the information in memory 710 for potential later use. Processor 708 processes the received sensor measurements and determines how the valves of the system should adjusted or positioned to obtain or maintain the proper flue gas temperature. The processor then sends via communication bus 712 and 716 one or more control signals to the transmitter 706 of I/O interface 702. The transmitter then transmits the one or more control signals shown as CTRL in the FIGS. 3, 6 and 7 to the appropriate devices (e.g., control and block valves 311, 317, 319, and 320 of FIG. 3 and control and block valves 608, 614, 616, and 617 of FIG. 6). Upon receipt of the control signals the control and block valves 311, 317, 319, 320 of FIG. 3 and the control and block valves 608, 614, 616, and 617 of FIG. 6 adjust their valve positions in accordance with the received control signal. In this manner, the system is able to obtain and or maintain the appropriate gas flue temperature during low load boiler operations. The communication link 331 may be wired and/or wireless links. The CTRL signal may be, and in some embodiments is, transmitted over the communication link 331. The CTRL signal may be, and in some embodiments is, transmitted over a separate communication link from the communication link 331.

While the exemplary embodiments have been described in connection with maintaining the gas temperature leaving a boiler at a suitably high temperature to allow SCR operation at boiler loads at which boiler exit gas temperatures are normally below the minimum operating temperature for SCRs, these are only exemplary applications of the present invention. For example, the present invention may, and in some embodiments, is used to maintain gas temperatures leaving an air heater above the dew point, to elevate air temperatures leaving an air heater when higher temperatures are required for coal drying and to provide higher gas temperatures for any other equipment downstream of the boiler exit whose operation might benefit from operation at higher temperatures.

In one embodiment of the present invention for controlling the temperature of a heated flue gas stream at a downstream device within a desired operating temperature range, the system comprises: a multipart heat exchanger comprising: a first heat exchanger section located in said flue gas stream said first heat exchanger section having a fluid inlet coupled to a fluid feed line; a second heat exchanger section located in series with said first heat exchanger section in said flue gas stream, said second heat exchanger section being located upstream of said first heat exchanger section in said flue gas stream; an intermediate header having a first mixer fluid input, a second mixer fluid input, and a fluid outlet, said first mixer fluid input being coupled to a fluid output of said first heat exchanger section, and said fluid outlet being coupled to a fluid inlet of said second heat exchanger section; and a fluid bypass line coupling said fluid feed line to said second mixer fluid input of said intermediate header, said fluid bypass line extending outside of said flue gas stream and providing a fluid bypass allowing at least some fluid supplied by said fluid feed line to fully bypass said first heat exchanger section.

In accordance with one aspect of the present invention, the system further comprises: a first temperature sensor in said flue gas stream in proximity of said intermediate header; a first valve located in series with said fluid bypass line for controlling an amount of fluid flow through said fluid bypass line; and a control module coupled to said first temperature sensor and said first valve, being configured to control a position of said first valve as a function of a temperature measured by said first temperature sensor.

In some embodiments of the present invention, the first valve is a multi-position valve; and the control module is configured to vary the amount of fluid flow through said bypass line in response to changes in sensed temperature indicated by said first temperature sensor.

In some embodiments of the present invention, the first heat exchanger section includes a fluid inlet header; and the system further includes: a second temperature sensor located in said flue gas stream in proximity to the fluid inlet header coupled to the control module.

In some embodiments of the present invention, the first heat exchanger section includes a fluid inlet header; and the system further includes: a second temperature sensor located in said flue gas stream in proximity to the boiler exit coupled to the control module.

In some embodiments of the present invention, the system further comprises: a fluid monitoring device located in the fluid bypass line and coupled to the control module; the fluid monitoring device configured to measure the flow of fluid through the bypass line and send fluid flow measurement information to said control module.

In some embodiments the control module of the system is further configured to: receive the fluid flow measurement information from the fluid monitoring device; and use said received fluid flow measurement information during said varying the amount of fluid flow through said bypass line in response to changes in sensed temperature indicated by said first temperature sensor.

In some embodiments of the present invention, the system further comprises: a second valve located between a fluid supply line and the fluid inlet header, the second valve controlling an amount of fluid supplied to the fluid inlet header; and wherein the control module is configured to control said second valve based on a temperature sensed by said second temperature sensor.

In some embodiments of the present invention, the multipart heat exchanger is located in a flue between a boiler which outputs said flue gas stream and a selective catalytic reduction (SCR) module.

In some embodiments of the present invention, the first heat exchanger section of the multipart heat exchanger is located in a common pass portion of a split pass convection flue.

In some embodiments of the present invention, the second heat exchanger section is located in one section of a split path portion of the split pass convection flue; and wherein a parallel split path portion of the split pass convention flue does not include a portion of said a multipart heat exchanger.

In some embodiments of the present invention, the second heat exchanger section is configured (e.g., is sufficiently long) to condense any steam received via said first and second inputs of said intermediate header.

In some embodiments of the present invention, exhaust piping is not required downstream of the heat exchanger outlet.

In some embodiments of the present invention, a safety valve is not required downstream of the heat exchanger outlet.

In some embodiments of the present invention, special mixing devices are not required at the output of the heat exchanger.

In some embodiments of the present invention, the system further comprises a third valve located between a fluid supply line and the fluid inlet header, the second valve being a block valve switchable between a fully open and a fully closed state; and the control module of the system is further configured to close said second valve when a desired flue gas operating temperature is detected by the first temperature sensor.

In some embodiments of the present invention the multipart heat exchanger is a multipart economizer.

In some embodiments of the present invention, the fluid bypass line comprises one or more tubes attached to both said inlet header and said intermediate header and provide structural support for both said inlet header and said intermediate header.

In an exemplary method for controlling the temperature of a heated flue gas stream at a location downstream of a multi-part heat exchanger within a desired operating temperature range in accordance with one embodiment of the present invention, the method comprises: sensing, using a first temperature sensor, a temperature in said flue gas stream in proximity to an intermediate header of said multipart heat exchanger, said multi-part heat exchanger including: a first heat exchanger section located in said flue gas stream said first heat exchanger section having a fluid inlet coupled to a fluid feed line; a second heat exchanger section located in series with the first heat exchanger section in the flue gas stream, the second heat exchanger section being located upstream of the first heat exchanger section in the flue gas stream; and the intermediate header having a first mixer fluid input, a second mixer fluid input, and a fluid outlet, the first mixer fluid input being coupled to a fluid output of the first heat exchanger section, and the fluid outlet being coupled to a fluid inlet of the second heat exchanger section; and a fluid bypass line coupling the fluid feed line to the second mixer fluid input of the intermediate header, the fluid bypass line extending outside of the flue gas stream and providing a fluid bypass allowing at least some fluid supplied by the fluid feed line to fully bypass the first heat exchanger section; and controlling a position of a bypass line control valve to control an amount of fluid passing through the fluid bypass line to the second mixer fluid input based on the temperature in the flue gas stream in proximity to the intermediate header of the multipart heat exchanger. In some embodiments of the exemplary method of the present invention, the bypass line control valve is a multi-position valve supporting multiple positions between a full open and a full closed position, and controlling the position of said bypass line control valve includes maintaining the bypass line in a full open state when the temperature measured by the first temperature sensor in the flue gas stream is below a first temperature and closing said valve as the temperature measured by said first temperature sensor increases beyond said first temperature.

In some embodiments of the exemplary method of the present invention, the method further comprises: sensing, using a second temperature sensor located in the flue gas stream in proximity to the fluid inlet header, a flue gas output temperature; and controlling the amount of fluid allowed to pass through said fluid bypass line to the second mixer fluid input is also based on the flue gas output temperature sensed by the second temperature sensor.

In some embodiments of the exemplary method of the present invention, the method further comprises: sensing, using a second temperature sensor located in the flue gas stream in proximity to the boiler exit, a flue gas output temperature; and controlling the amount of fluid allowed to pass through said fluid bypass line to the second mixer fluid input is also based on the flue gas output temperature sensed by the second temperature sensor.

In some embodiments of the present invention, controlling the position of said bypass line control valve of the exemplary method of the present invention includes maintaining said bypass line control valve in a fully closed state when the second temperature sensor indicates the flue gas output temperature is in a desired operating range.

In some embodiments of the present invention, the exemplary method further comprises: controlling a position of an economizer flow control valve, from a minimally open position to a fully open position, to control an amount of fluid passing through the first heat exchanger section as a function of at least one of the temperature measured by the first temperature sensor or the temperature measured by the second temperature sensor.

In some embodiments of the present invention, controlling a position of an economizer flow control valve of the exemplary method includes opening the economizer flow control valve when the first temperature sensor indicates a temperature which increases over said first temperature.

In some embodiments of the present invention, controlling the position of the economizer flow control valve of the exemplary method is further based on the flue gas output temperature sensed by the second temperature sensor in addition to the temperature sensed by the first temperature sensor.

In some embodiments of the present invention, controlling the position of the economizer flow control valve of the exemplary method includes: controlling the economizer flow control valve to operate in a fully open state after: (i) said second temperature sensor senses a flue gas output temperature that is in a desired operating range, (ii) said bypass line control valve has been put in a fully closed state, and (iii) said economizer flow control valve has been opened to the fully open state.

In some embodiments of the present invention, controlling the economizer flow control valve of the exemplary method includes maintaining at least some flow through the economizer flow control valve during all times of operation.

In some embodiments of the present invention, controlling the economizer flow control valve of the exemplary method includes maintaining at least 10% of the maximum fluid flow through the economizer flow control valve during all times of operation.

In some embodiments of the present invention, the exemplary method further comprises: measuring the flow of fluid through the economizer flow control valve; and controlling the position of said economizer flow control valve is further based on the measured flow in addition to the flue gas output temperature measured by the second temperature sensor, the fluid flow through the economizer flow control valve being controlled to keep the output temperature in a desired range after the bypass line control valve has been fully closed.

In various embodiments system/apparatus elements described herein are implemented using one or more modules which are used to perform the steps and/or sub-steps corresponding to one or more methods of the present invention. Each step may be performed and/or controlled by one or more different software instructions executed by a computer processor, e.g., a central processing unit (CPU). In some embodiments the control module may be and is implemented in software. In some embodiments the modules, e.g., control module may be, and are implemented in hardware, e.g., as circuits. In some embodiments the modules, e.g., control module, may be, and are, implemented in a combination of hardware and software.

In various embodiments a device of any of one or more of the figures includes a module corresponding to each of the individual steps and/or operations described in the present application.

The techniques of various embodiments may be implemented using software, hardware and/or a combination of software and hardware. Various embodiments are directed to methods, e.g., method of controlling and/or operating a heat exchange system. Various embodiments are also directed to machine, e.g., computer, readable medium, e.g., ROM, RAM, CDs, hard discs, etc., which include machine readable instructions for controlling a machine, e.g., heat exchange system, to implement one or more steps of a method described in the present application. The computer readable medium is, e.g., a non-transitory computer readable medium in at least some embodiments.

It is understood that the specific order or hierarchy of steps in the processes disclosed is an example of exemplary approaches. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

Numerous additional variations on the methods and apparatus of the various embodiments described above will be apparent to those skilled in the art in view of the above description. Numerous additional embodiments and variations will be apparent to those of ordinary skill in the art in view of the above description and the claims which follow and are within the scope of the present invention.

What is claimed is:

1. A method for controlling the temperature of a heated flue gas stream at a location downstream of a multi-part heat exchanger within a desired operating temperature range, the method comprising:

sensing, using a first temperature sensor, a temperature in said flue gas stream in proximity to an intermediate header of said multipart heat exchanger, said multi-part heat exchanger including:

a first heat exchanger section located in said flue gas stream said first heat exchanger section having a fluid inlet coupled to a fluid feed line;

a second heat exchanger section located in series with said first heat exchanger section in said flue gas stream, said second heat exchanger section being located upstream of said first heat exchanger section in said flue gas stream; and said intermediate header having a first mixer fluid input, a second mixer fluid input, and a fluid outlet, said first mixer fluid input being coupled to a fluid output of said first heat exchanger section, and said fluid outlet being coupled to a fluid inlet of said second heat exchanger section; and a fluid bypass line coupling said fluid feed line to said second mixer fluid input of said intermediate header, said fluid bypass line extending outside of said flue gas stream and providing a fluid bypass allowing at least some fluid supplied by said fluid feed line to fully bypass said first heat exchanger section; and controlling a position of a bypass line control valve to control an amount of fluid passing through said fluid bypass line to the second mixer fluid input based on said temperature in said flue gas stream in proximity to the intermediate header of said multipart heat exchanger.

2. The method of claim 1, wherein said bypass line control valve is a multi-position valve supporting multiple positions between a full open and a full closed position; and wherein said controlling the position of said bypass line control valve includes maintaining said bypass line in a full open state when said temperature measured by said first temperature sensor in said flue gas stream is below a first temperature and closing said valve as said temperature measured by said first temperature sensor increases beyond said first temperature.

3. The method of claim 2 further comprising:

sensing, using a second temperature sensor located in said flue gas stream in proximity to a flue gas outlet, a flue gas output temperature; and wherein controlling the amount of fluid allowed to pass through said fluid bypass line to the second mixer fluid input is also based on the flue gas output temperature sensed by said second temperature sensor.

4. The method of claim 3, wherein controlling the position of said bypass line control valve includes:

maintaining said bypass line control valve in a fully closed state when said second temperature sensor indicates the flue gas output temperature is in a desired operating range.

5. The method of claim 2 further comprising:

controlling a position of an economizer flow control valve, from a minimally open position to a fully open position, to control an amount of fluid passing through said first heat exchanger section as a function of at least one of the temperature measured by said first temperature sensor or the temperature measured by said second temperature sensor.

6. The method of claim 5, wherein controlling a position of an economizer flow control valve includes opening the economizer flow control valve when said first temperature sensor indicates a temperature which increases over said first temperature.

7. The method of claim 6, wherein controlling the position of said economizer flow control valve is further based on the flue gas output temperature sensed by said second temperature sensor in addition to the temperature sensed by said first temperature sensor.

8. The method of claim 7, wherein controlling the position of the economizer flow control valve includes:

controlling the economizer flow control valve to operate in a fully open state after: (i) said second temperature sensor senses a flue gas output temperature that is in a desired operating range, (ii) said bypass line control valve has been put in a fully closed state, and (iii) said economizer flow control valve has been opened to the fully open state.

9. The method of claim 8, wherein controlling the economizer flow control valve includes maintaining at least some flow through the economizer flow control valve during all times of operation.

10. The method of claim 9, wherein said at least some flow is not less than 10% of the maximum fluid flow through said economizer flow control valve.

* * * * *